US006292151B1

(12) United States Patent
Wu

(10) Patent No.: US 6,292,151 B1
(45) Date of Patent: Sep. 18, 2001

(54) ANTENNA FOR MOBILE PHONE

(75) Inventor: Mao-Sung Wu, Taoyuan (TW)

(73) Assignee: Senton Enterprise Co., Ltd., Pa Te (TW)

( * ) Notice: Subject to any disclaimer, the term of this patent is extended or adjusted under 35 U.S.C. 154(b) by 0 days.

(21) Appl. No.: 09/739,813

(22) Filed: Dec. 20, 2000

(51) Int. Cl.[7] ..... H01Q 1/06
(52) U.S. Cl. ..... 343/721; 343/702; 343/872
(58) Field of Search ..... 343/702, 721, 343/720, 722, 741, 806, 860, 866, 872; 340/432, 478, 479; 455/90; H01Q 1/06

(56) References Cited

U.S. PATENT DOCUMENTS 3,900,725 * 8/1975 Komon ..... 240/7.5
4,039,894 * 8/1977 Gardner ..... 315/76
4,989,013 * 1/1991 Smith et al. ..... 343/721
5,278,556 * 1/1994 Oh ..... 340/988
5,448,456 * 9/1995 Huynh ..... 343/721
5,933,081 * 8/1999 Jones ..... 340/539
6,130,646 * 10/2000 Jang ..... 343/721

* cited by examiner

*Primary Examiner*—Tho G Phan
(74) *Attorney, Agent, or Firm*—Birch, Stewart, Kolasch, & Birch, LLP

(57) ABSTRACT

An antenna for mobile phone mainly includes a low-profile multi-layered circuit board mounted on a base and protectively covered with a light-transmissible hood fitted around the base. The low-profile multi-layered circuit board is provided at a reverse side with a printed antenna and at a front side with a half-wave voltage-doubling circuit and a light-emitting element. A power input of the half-wave voltage-doubling circuit is replaced with a printed inductance for inducing an alternating voltage and generating a resonance to eliminate a capacitive reactance in a diode included in the circuit. The diode rectifies the induced alternating voltage to a direct voltage for driving the light-emitting element to emit lights. When additional n diodes and n capacitances are parallelly connected to the half-wave voltage-doubling circuit, a half-wave voltage-multiplying circuit is constituted, so that an amplified output voltage (n+1)Vm times as large as a received voltage signal can be obtained to drive multiple light-emitting elements connected to the output of the circuit to emit lights.

4 Claims, 7 Drawing Sheets

ANTENNA FOR MOBILE PHONE

BACKGROUND OF THE INVENTION

The present invention relates to an antenna for mobile phone, and more particularly to an antenna for mobile phone that uses a printed circuit to replace the conventional coil antenna, so that the antenna is manufactured at reduced cost and provides increased frequency stability.

With the increasingly grown technology nowaday, mobile phones have not only largely reduced dimensions but also changeful appearances. However, most mobile phones have an antenna that is almost unchanged—a black, thick and short bar projected from a top of the mobile phone and having simple functions of receiving and transmitting signals. There are manufacturers developing some antennas for mobile phone that are able to emit lights, in addition to receive and transmit signals, enabling users to know current conditions of their mobile phones through not only sound and vibration, but also light.

FIG. 7 is an exploded perspective showing the structure of a conventional antenna 1 for mobile phone. The antenna 1 mainly includes a clear hood 11, an antenna 12, a light-emitting element 13, a separating plate 14, an insulating member 15, a signal needle 16, a coiled member 17, and a base 18. The separating plate 14 is fixedly connected to a top of the signal needle 16 for setting in the coiled member 17. The separating plate 14 prevents the antenna 12 from contacting with the coiled member 17 and thereby protects the antenna 12 against short circuit that would cause failure of the antenna 12 in receiving and transmitting signals. An upper side of the separating plate 14 is electrically conductive for a lower end of the antenna 12 and a first pin of the light-emitting element 13 to fixedly weld thereto. The base 18 is in the form of a funnel and is provided with an axially extended through hole 181. The through hole 181 is provided on an inner peripheral wall with an insulting layer to prevent the signal needle 16 located in the through hole from unexpected contacting with the base 18 to result in short circuit and failure in receiving and transmitting signals. The insulting member 15 is a cylindrical member connected to and around the signal needle 16, such that the insulting member 15 is set in an upper end of the through hole 181. A second pin of the light-emitting element 13 is welded to a top of the coiled member 17. The base 18 has an externally threaded portion for the base 18 to screw onto a top of a mobile phone and contact with a negative electrode of a power supply in the mobile phone. Finally, the clear hood 11 is closed onto the base 18 to enclose the antenna 12.

The above-described conventional antenna for mobile phone has complicate components that could not be easily assembled together, and therefore requires increased manufacturing cost and selling price. The above-described conventional antenna for mobile phone also has the following drawbacks:

1. The high number of complicate components tends to result in errors in assembling the antenna to adversely affect the quality of received signals.
2. In the conventional antenna that also emits lights, a voltage signal at the output of the antenna has a maximum value equal to a peak value Vm thereof, and only limited number of light-emitting elements (loads) at the output can be driven by the output voltage to emit lights.

In view of the drawbacks existing in the conventional antenna for mobile phone, it is tried by the inventor to develop an improved antenna for mobile phone to eliminate such drawbacks.

SUMMARY OF THE INVENTION

A primary object of the present invention is to provide an antenna for mobile phone that uses a printed circuit to replace the conventional coil antenna, so as to reduce the manufacturing cost of the antenna and increase the frequency stability thereof.

Another object of the present invention is to provide an antenna for mobile phone that includes at least one light-emitting element for emitting lights as an indicator of receiving signals.

To achieve the above and other objects, the antenna for mobile phone according to the present invention mainly includes a low-profile multi-layered circuit board mounted on a base and protectively covered with a light-transmissible hood fitted around the base. The low-profile multi-layered circuit board is provided at a reverse side with a printed antenna and at a front side with a half-wave voltage-doubling circuit and a light-emitting element. A power input of the half-wave voltage-doubling circuit is replaced with a printed inductance for inducing an alternating voltage and generating a resonance to eliminate a capacitive reactance in a diode included in the circuit. The diode rectifies the induced alternating voltage to a direct voltage for driving the light-emitting element to emit lights. When additional n diodes and n capacitances are parallelly connected to the half-wave voltage-doubling circuit, a half-wave voltage-multiplying circuit is constituted, so that an amplified output voltage (n+1)Vm times as large as a received voltage signal can be obtained to drive multiple light-emitting elements connected to the output of the circuit to emit lights.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
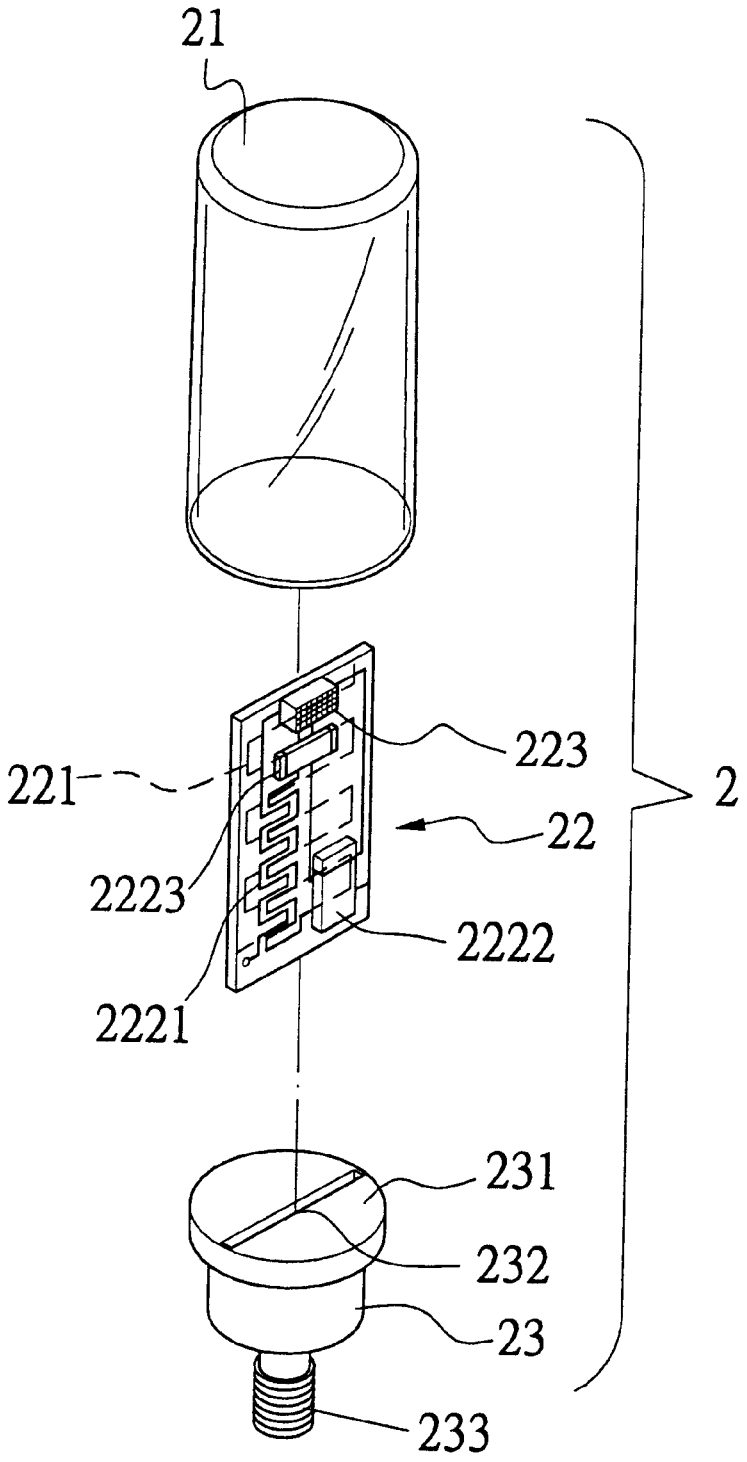
FIG. 1 is an exploded perspective of an antenna for mobile phone according to a first embodiment of the present invention
Figure 2:
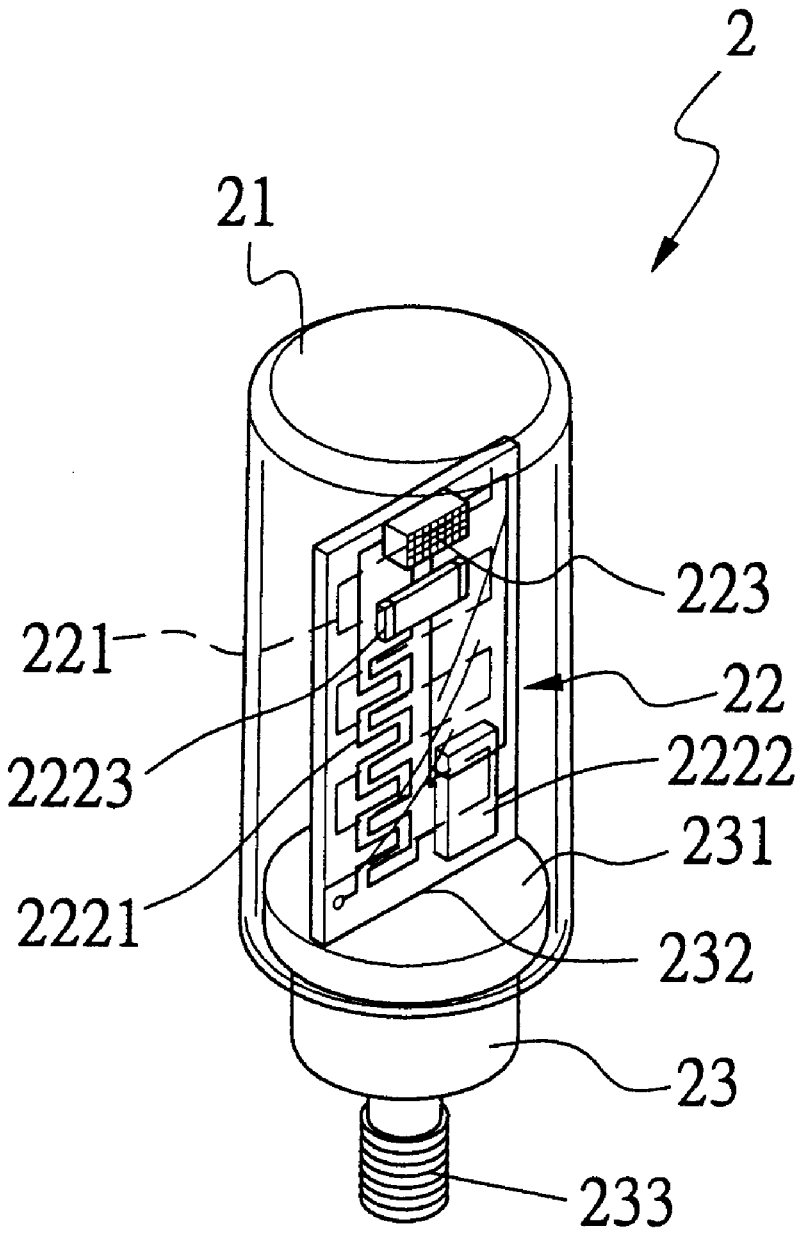
FIG. 2 is an assembled perspective of the antenna of FIG. 1.
Figure 6:
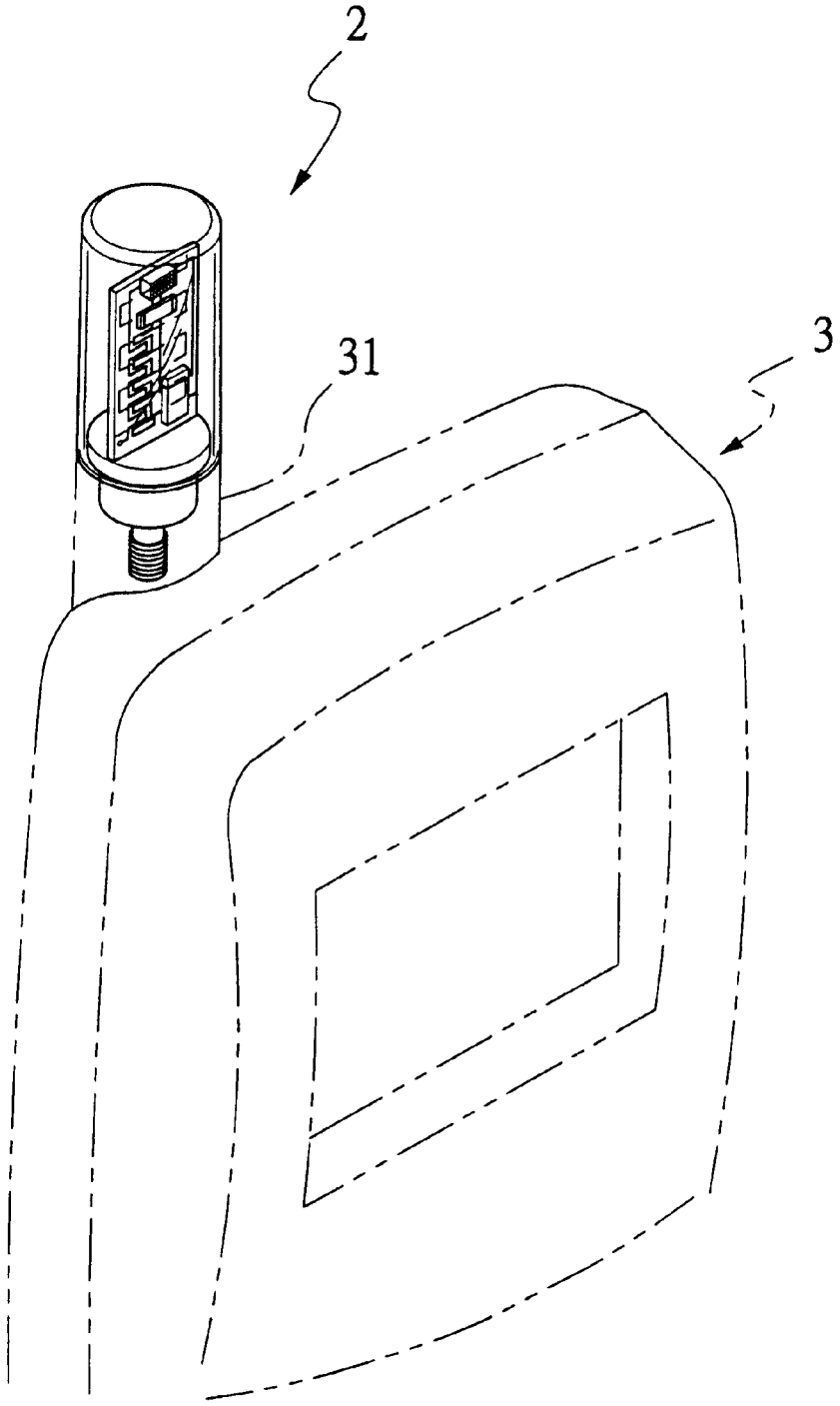
FIG. 6 shows the connection of an antenna of the present invention to a mobile phone.
Figure 7:
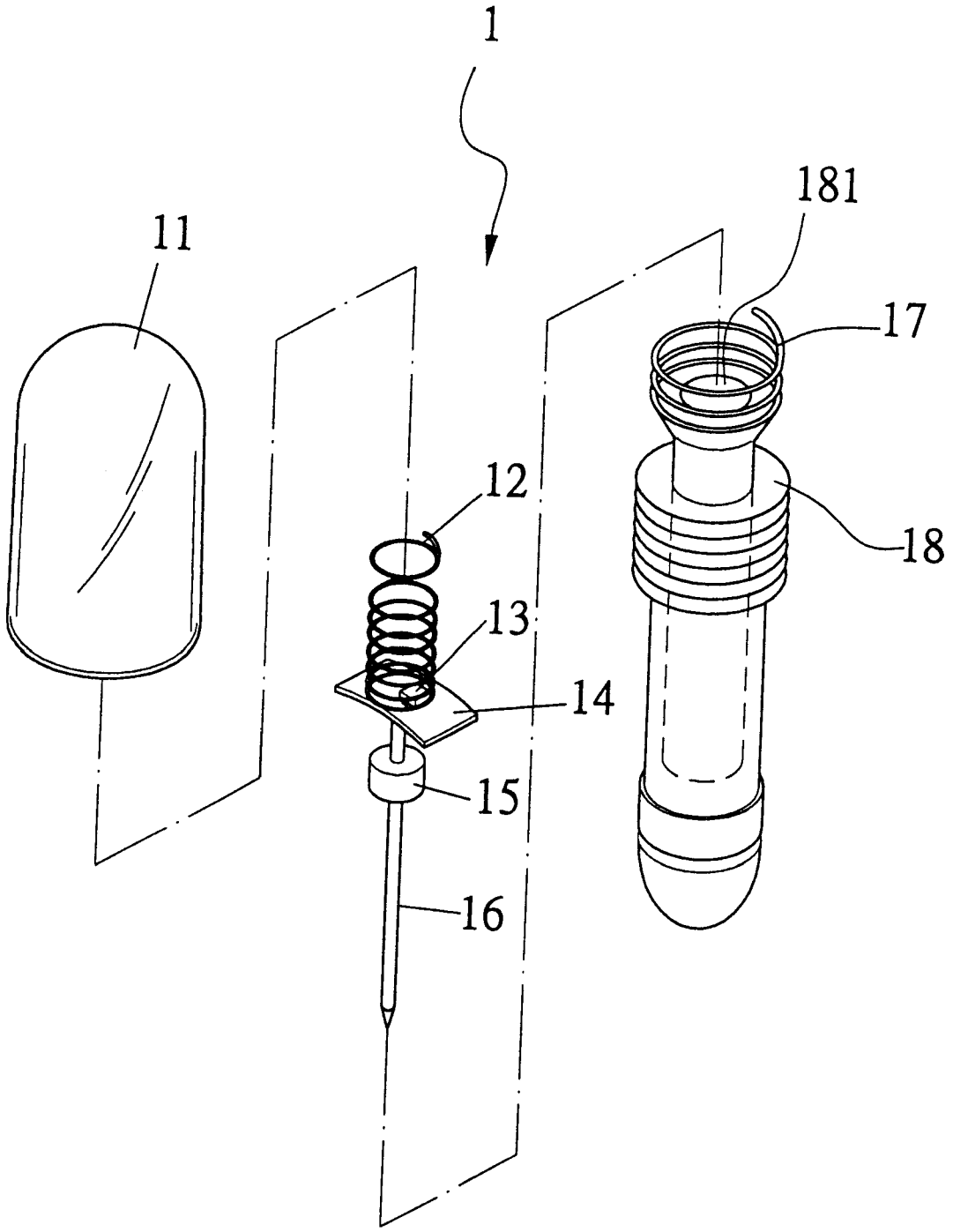
(PRIOR ART) Fig.7
FIG. 7 is an exploded perspective of a conventional antenna for mobile phone.

Please refer to FIGS. 1 and 2 that are exploded and assembled perspective views, respectively, of an antenna 2 for mobile phone according to a first embodiment of the present invention. As shown, the antenna 2 mainly includes a light-transmissible hood 21, a low-profile multi-layered circuit board 22, and a base 23. The light-transmissible hood 21 is a close-topped round tube adapted to connect a bottom thereof to and around the base 23. The base 23 includes a round flat top 231 that is electrically conductive. The flat top 231 is provided at an upper surface with a slot 232 into which the low-profile multi-layered circuit board 22 is inserted, and at a lower surface with a downward extended bolt 233. The low-profile multi-layered circuit board 22 is a rectangular board and is printed at a reverse side with a printed antenna 221 and at a front side with a half-wave voltage-multiplying circuit 224 and a light-emitting element 223. The antenna 2 assembled from the above-mentioned components can be directly connected to a mobile phone 3 by screwing the bolt 233 into an antenna hole 31 provided on the mobile phone 3, as shown in FIG. 6.

Figure 3:
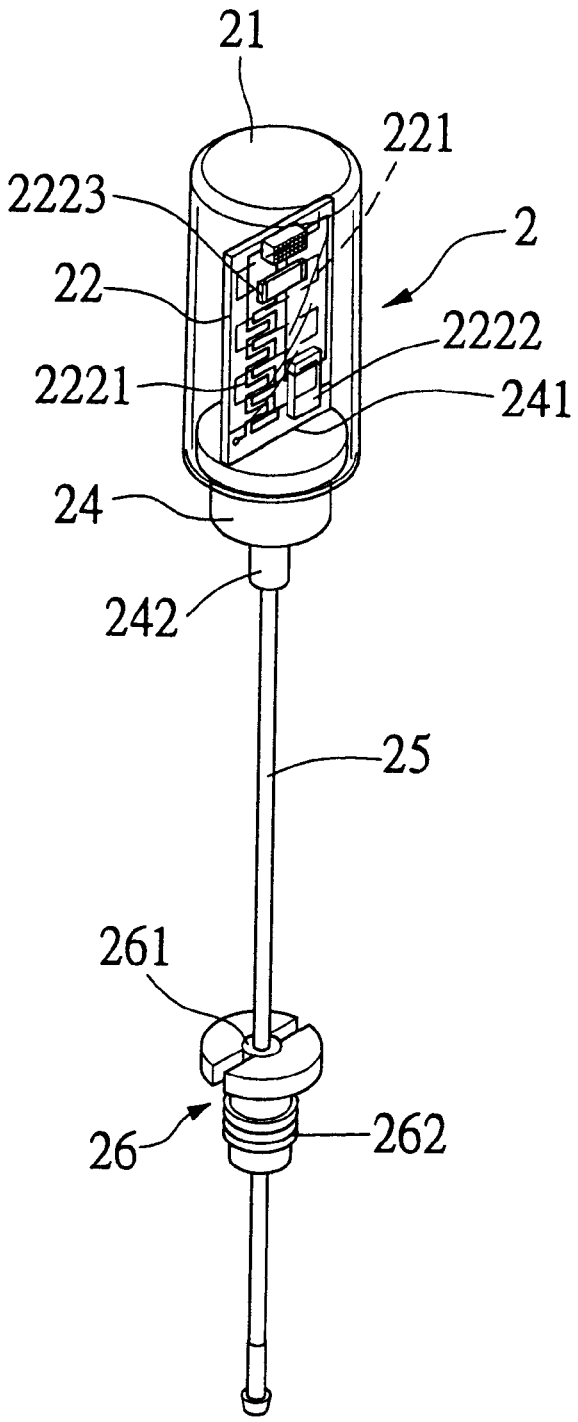
FIG. 3 is an assembled perspective of an antenna for mobile phone according to a second embodiment of the present invention.

FIG. 3 shows an antenna for mobile phone according to a second embodiment of the present invention. The antenna 2 in this second embodiment is generally similar to the antenna 2 in the first embodiment, except it uses a round flat-topped conductive seat 24 to replace the base 23 in the first embodiment and further includes a retractable support 25 and a base 26. The seat 24 is provided at its flat top with a slot 241 into which the circuit board 22 is inserted, and at its lower surface with a connecting head 242 for connecting an upper end of the retractable support 25. The base 26 is provided at a center with an axially extended through hole 261 and at a lower surface with a downward extended bolt 262 adapted to screw into the antenna hole 31 on the mobile phone 3. A lower end of the retractable support 25 is downward extended through the through hole 261, such that the retractable support 25 is axially movable in the through hole 261 relative to the base 26.

Figure 4:
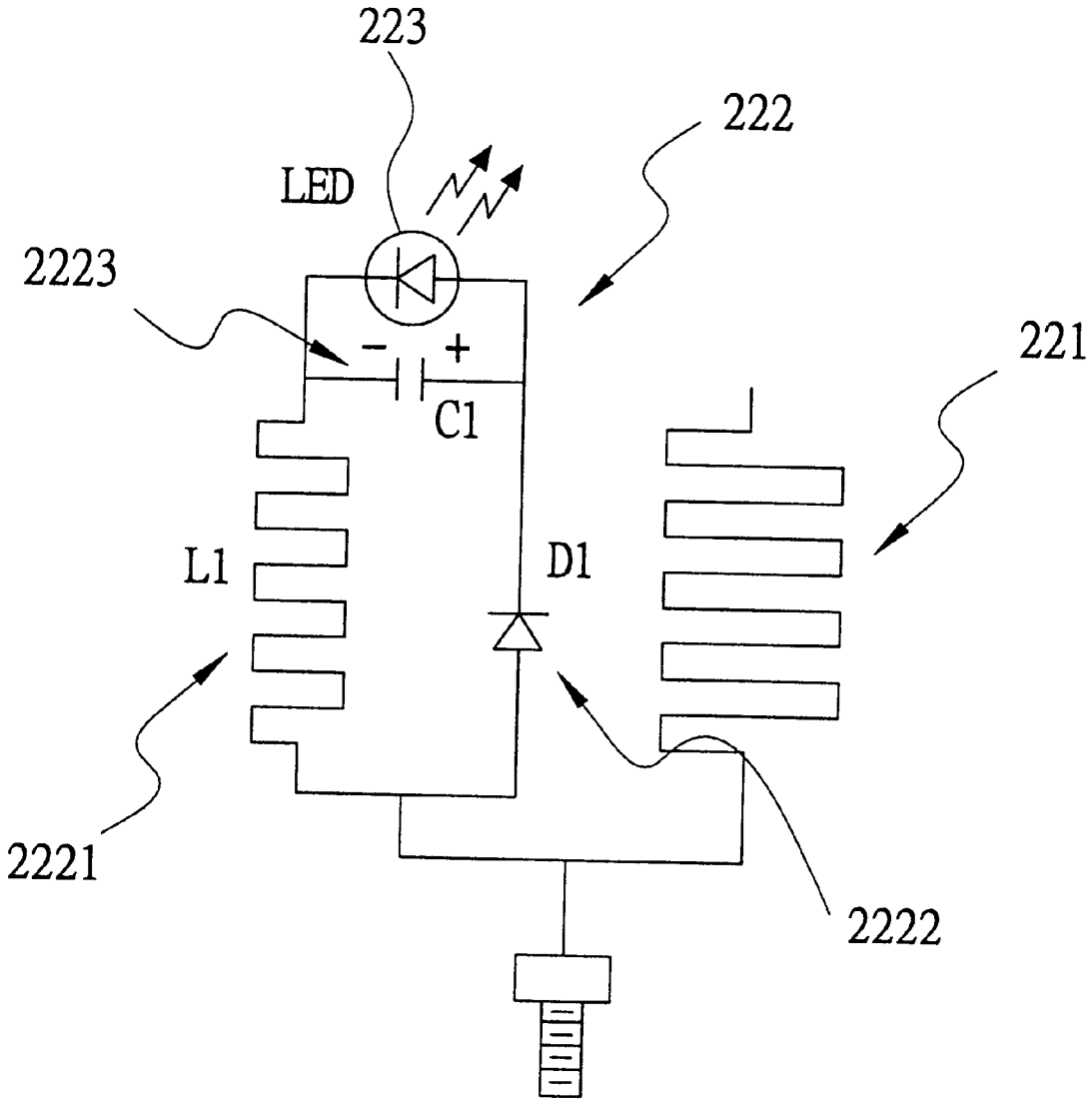
FIG. 4 is a circuit diagram showing the half-wave circuit adopted in the present invention.

FIG. 4 shows a half-wave circuit for the antenna of the present invention. As shown, the half-wave circuit includes a printed antenna 221 provided at a reverse side of the low-profile multi-layered circuit board 22, and a half-wave voltage-doubling circuit 222 and a light-emitting element 223 provided at a front side of the low-profile multi-layered circuit board 22.

The printed antenna 221 is provided at a reverse side of the low-profile multi-layered circuit board 22 for receiving and transmitting high-frequency signals and sending received voltage signals to an input of the half-wave voltage-doubling circuit 222. The half-wave voltage-doubling circuit 222 includes an inductance 2221 that replaces a power input of the circuit 222 for inducing an alternating voltage, a diode 2222 and a capacitance 2223. The inductance 2221 resonates with a sum of a micro capacitance in the diode 2222 and a capacitivity of the capacitance 2223 and eliminates a capacitive reactance in the diode 2222. The induced alternating voltage is rectified by the diode 2222 to be direct voltage.

Figure 5:
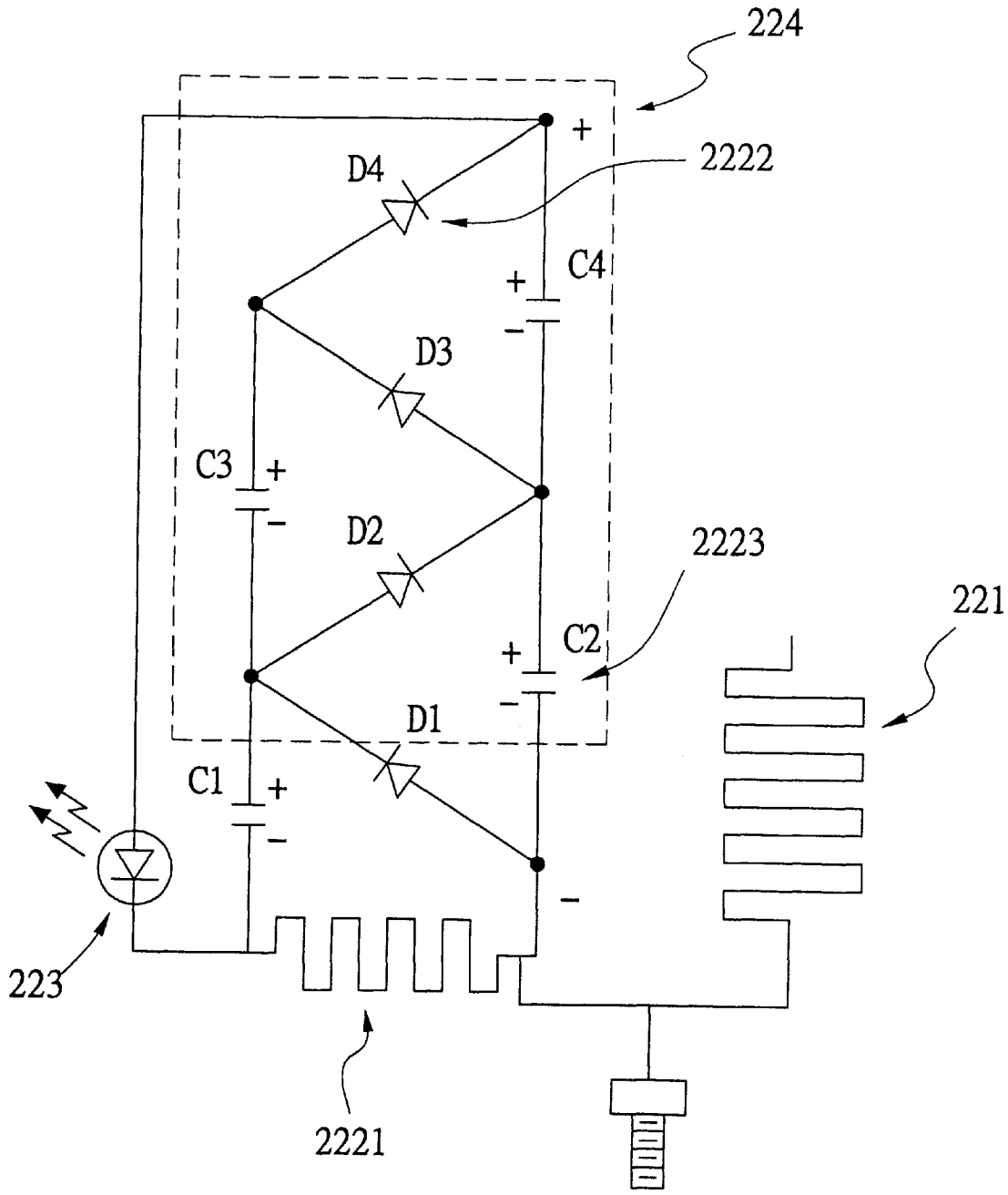
FIG. 5 is a circuit diagram showing the half-wave voltage-multiplying circuit adopted in the present invention.

In the event there are multiple, for example, n+1 light-emitting elements 223 to be driven, n diodes 2222 and n capacitances 2223 must be parallelly connected to the circuit 222 to constitute a half-wave voltage-multiplying circuit 224, as shown in the frame indicated with broken lines in FIG. 5, so that the half-wave voltage-multiplying circuit 224 is able to amplify a received voltage signal to a maximum output voltage that is (n+1)Vm times as large as the originally received voltage signal to drive all the light-emitting elements 223 at the output of the half-wave circuit of the antenna for mobile phone according to the present invention.

The light-emitting element 223 is a light emitting diode. When a direct-voltage signal from the half-wave voltage-doubling circuit 222 or the half-wave voltage-multiplying circuit 224 drives the light emitting diode 223, the light emitting diode 223 emits lights. Since the half-wave voltage-multiplying circuit 224 is able to amplify an input voltage Vm to output an amplified output voltage (n+1)Vm, it is possible to provide multiple light emitting diodes (loads) at the output of half-wave circuit of the present invention.

With the above arrangements, the antenna for mobile phone according to the present invention provides at least the follow advantages:

1. Either the regular or the retractable antenna of the present invention can be conveniently and quickly mounted on a mobile phone.
2. The antenna of the present invention adopts integrated printed circuit and simple structure that facilitates reduction of manufacturing cost and quick assembling of the antenna into a finish product for mounting on a mobile phone and therefore benefits consumers.
3. The half-wave voltage-multiplying circuit of the present invention provides an amplified output voltage (n+1)Vm times as large as the received voltage. Therefore, multiple light emitting diodes (loads) can be connected to the output of the circuit.

What is claimed is:

1. An antenna for mobile phone, comprising a light-transmissible hood, a low-profile multi-layered circuit board protectively covered by said hood, and a base onto which said low-profile multi-layered circuit board is mounted and around which said hood is fitted; said antenna being characterized in that:

said low-profile-multi-layered circuit board is provided at a reverse side with a printed antenna and at a front side with a half-wave voltage-doubling circuit and at least one light-emitting element; a power input of said half-wave voltage-doubling circuit being replaced with a printed inductance for inducing an alternating voltage and generating resonance to eliminate a capacitive reactance in a diode that is included in said half-wave voltage-doubling circuit for rectifying said induced alternating voltage to a direct voltage for driving said at least one light-emitting element to emit lights.

2. An antenna for mobile phone as claimed in claim 1, wherein said light-emitting element is a light emitting diode.

3. An antenna for mobile phone as claimed in claim 1, wherein said low-profile multi-layered circuit board includes two or more of said light-emitting elements.

4. An antenna for mobile phone as claimed in claim 1, wherein said half-wave voltage-doubling circuit is adapted to parallelly connect to additional n diodes and n capacitances to constitute a half-wave voltage-multiplying circuit that amplifies a received voltage signal to an output voltage (n+1)Vm times as large as said received voltage signal.

* * * * *